United States Patent [19]

Redfield

[11] 3,980,852

[45] Sept. 14, 1976

[54] ADJUSTABLE HIGH DENSITY CAM-SWITCH ASSEMBLY

[75] Inventor: Charles L. Redfield, Woodridge, Ill.

[73] Assignee: Litton Industrial Products, Inc., Elk Grove Village, Ill.

[22] Filed: Jan. 20, 1975

[21] Appl. No.: 542,362

[52] U.S. Cl. ..... 200/153 LB; 200/38 B

[51] Int. Cl.[2] ..... H01H 21/28

[58] Field of Search..... 200/153 LB, 286, 249, 200/38 B, 153 T, 38 R, 38 BA, 38 C, 38 CA, 168 R

[56] References Cited

UNITED STATES PATENTS

| | | | |
|---|---|---|---|
| 2,939,924 | 6/1960 | Franck | 200/153 LB |
| 3,569,992 | 3/1971 | Papa, Jr. | 200/38 B |
| 3,621,172 | 11/1971 | Clark | 200/153 LB |
| 3,670,128 | 6/1972 | Estrem | 200/153 LB |
| 3,770,924 | 11/1973 | Hipple et al. | 200/286 |

*Primary Examiner*—Herman J. Hohauser
*Attorney, Agent, or Firm*—Robert M. Vargo

[57] ABSTRACT

A cam-switch assembly is disclosed in which the individual cam-switches are individually adjustable with respect to the registering cams. The cam-switch assembly comprises a support bracket having at least two parallel end walls supporting a pivot rod and a cam shaft. The cam shaft functions to support a plurality of cams coaxially mounted thereon. A plurality of cam switches are provided with each cam-switch including a cam follower responsive to a respective cam for actuating the switch. A plurality of mounting brackets are pivotally mounted on the pivot rod with each bracket supporting a respective cam-switch by means of the pivot rod and properly positioned anchor which is an integral part of the mounting bracket. Each mounting bracket includes a cantilevered end formed in a U-shaped configuration with one leg of the "U" having a slot formed thereon for adjustably receiving a locking screw. The other leg of the U includes a threaded bore for securedly receiving a locking screw. The leg having the threaded bore functions to form a fixed surface for an adjacent mounting bracket. The leg having the slot formed thereon functions to enable the mounting bracket to be adjustably positioned with respect to the fixed surface adjacent thereto.

6 Claims, 4 Drawing Figures

Fig. 1
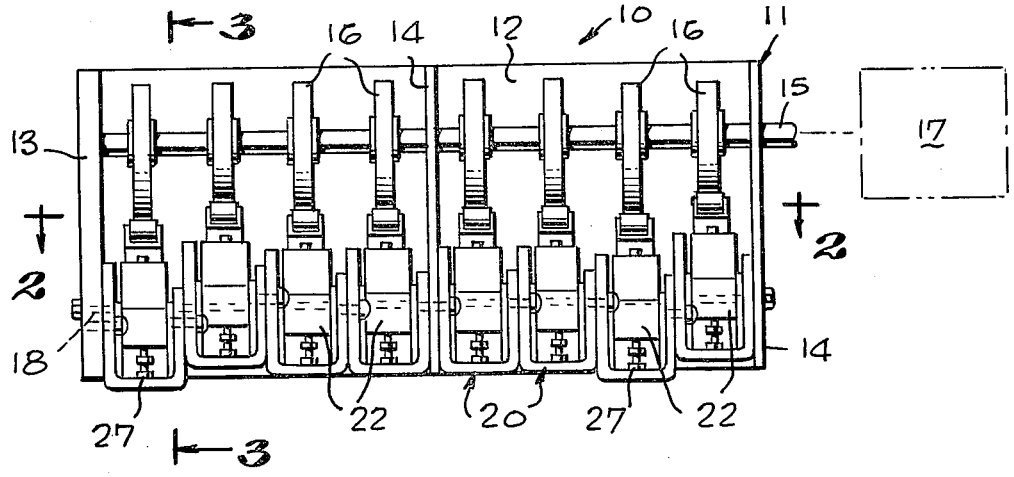
Fig. 2
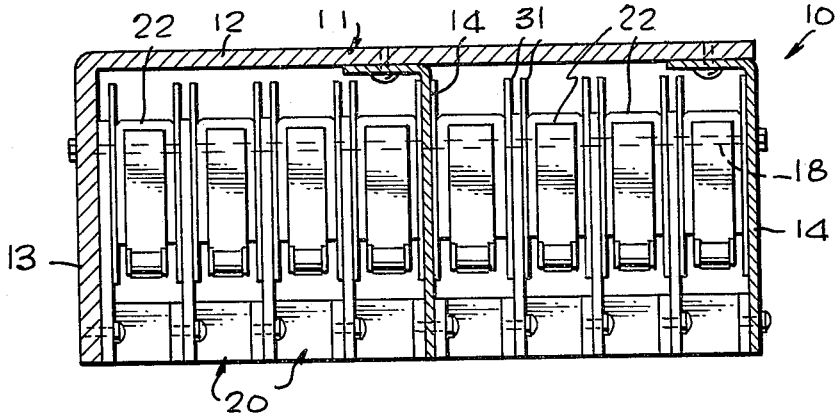
Fig. 4
Fig. 3
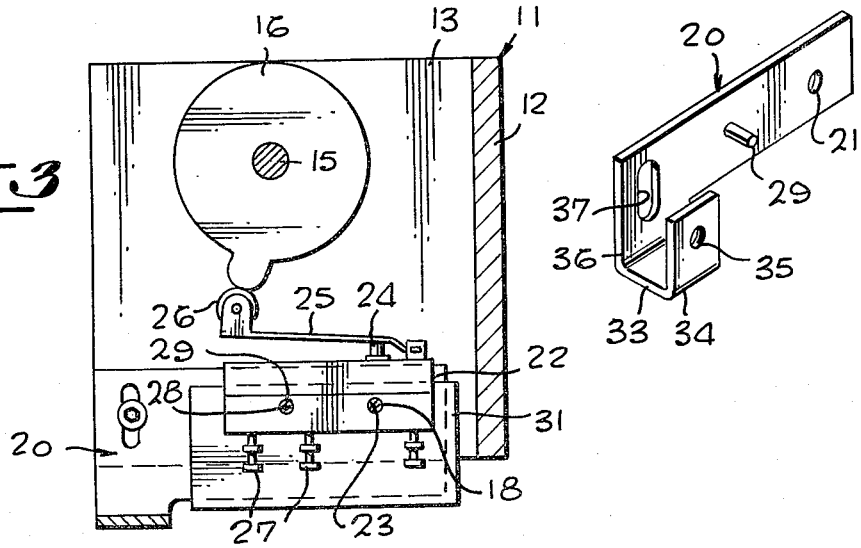

ADJUSTABLE HIGH DENSITY CAM-SWITCH ASSEMBLY

BACKGROUND OF THE INVENTION

1. Field of the Invention

The present invention relates generally to high density cam-switch assemblies and more particularly to means for adjusting such assemblies.

2. Description of the Prior Art

Microswitches or cam-switches are found in a myriad of applications in present day technology. In many installations, a plurality of such switches are utilized in modular fashion and are mounted in tight fitting and cramped corners. In such installations, it is quite difficult to adjust the switches to properly mate with the registering cams. Moreover, because the switches are usually positioned along a row, they are usually placed on a common plane and the only adjustment made is the relative position of the module with respect to the row of cams. In these installations, no provisions are made for individual cams. Because of the relatively high manufacturing tolerances built into the microswitches, it is indeed preferable to have the capability of individual switch adjustments.

It has been found that there is a high incidence of misalignment in such modular installations. After the row of switches has been aligned with the cams and the cams are rotated, an unacceptably high number of switches fail to be actuated. When this occurs, the entire module must be discarded and a new module is inserted until one is found where all of the switches are actuated.

SUMMARY OF THE INVENTION

The present invention obviates the above-mentioned shortcoming by providing a high density cam-switch assembly in which each individual switch of the assembly is easily and accurately adjustable with respect to its registering cam.

In its broadest aspect, the present invention pertains to cam-switch module comprising a pivot rod pivotally supporting a plurality of mounting brackets. A plurality of cam-switches are provided with each cam-switch having a cam follower responsive to a registering cam for actuating the switch. The mounting brackets further include locking and positioning structure for individually adjusting the angular position of each bracket and cam-switch with respect to the registering cams.

A primary advantage of the present invention is that individual adjustments are possible to allow each mounting bracket and cam-switch assembly to establish a relation between the cam axis and the switch actuation point.

The features of the present invention, which are believed to be novel, are set forth with particularity in the appended Claims. The present invention, both as to its organization and manner of operation, together with the further advantages thereof, may best be understood by reference to the following description taken in connection with the accompanying drawings.

BRIEF DESCRIPTION OF THE DRAWINGS

FIG. 1 is an elevational view of the cam-switch assembly of the present invention;

FIG. 2 is a plan view of the cam-switch assembly taken along lines 2—2 of FIG. 1.

FIG. 3 is a side view, partially in section, of the cam switch assembly taken along lines 3—3 of FIG. 1.

FIG. 4 is an isometric view of the adjustable mounting bracket utilized in the cam switch assembly of the present invention.

DETAILED DESCRIPTION OF THE PREFERRED EMBODIMENT

Referring now to the drawings, FIGS. 1–3 illustrate cam-switch assembly generally indicated by arrow 10 comprising a mounting bracket 11 consisting of a back wall 12 and a side wall 13. A pair of support plates 14 are also divided to be attached to the back wall 12 of the mounting bracket 11 to provide additional side wall support structure for the cam switch assembly 10. The side walls 13 and 14 are provided with a first set of apertures for receiving a cam shaft 15 having a plurality of cams 16 mounted thereon. Cam shaft 15 is rotatably driven by a suitable motor shown schematically by box 17.

The side walls 13 and 14 also include a second set of apertures for receiving a pivot rod 18.

A plurality of adjustable mounting brackets 20 are positioned between the walls 13 and 14 in an aligned manner with each mounting bracket 20 including a pivot hole 21 for receiving the pivot rod 18. A plurality of cam switches 22 are provided with each cam switch being mounted adjacent a respective adjustable mounting bracket 20. Each cam switch further includes a bore 23 extending through the one end thereof for receiving the pivot rod 18. Each cam switch mechanism 22 also includes a reciprocating switch 24 adapted to engage a bearing surface of a cam follower 25. A roller 26 is mounted on the cantilivered end of each cam follower 25 for engagement with the surface of each cam 16. A plurality of terminals 27, adapted to receive electrical leads, are located on the bottom of each cam switch 22. Each cam switch 22 is further provided with a second bore 28 for receiving an anchor 29 integrally formed on each of the adjustable mounting brackets 22. Such an anchor construction allows each mounting bracket 20 to pivot in unison with its mating cam switch 22, to allow the combination to pivot in unison.

A plurality of insulating plates 31 are also pivotally mounted on the pivot rod 18 and are located between each mounting bracket cam-switch combination.

As more clearly shown in FIG. 4, the cantilevered end of each mounting bracket 20 includes a U-shaped member 33. The one leg 34 of the U has a threaded bore 35 extending therethrough, while the other leg 36 has an elongated slot 37 extending therethrough.

A similar threaded bore 35 is also located on the side wall 13 and the middle side wall 14 while the end side wall 14 has an elongated slot 37 extending therethrough.

OPERATION

In individually adjusting the angular position of each mounting bracket, the side wall 13, the middle side wall 14, and the leg 34 of the mounting bracket 20 function as fixed locking surfaces for the adjacent mounting brackets. Moreover, the legs 36 of the mounting brackets 20 function as the adjustment means for the brackets 20.

In securing each bracket 20, a locking screw 40 is utilized to interlock each adjacent brackets 20. The first bracket 20 to be secured is the bracket 20 adjacent the end wall 13. The locking screw 40 is first passed through the elongated slot 37 and loosely threaded into the bore 35 of the end wall 13. The bracket 20 is then pivoted until its desired angular position with the cam axis is found. This angular movement is possible because of the slot 37. After the desired angular position of the bracket is found, the locking screw 40 is tightened in the bore 35 to lock the bracket 20 against the fixed end wall 13.

In this fixed position of the bracket 20 against the end wall 13, the leg 34 of this first bracket 20 functions as a fixed surface for the second bracket 20 located adjacent the first. The above procedure is then repeated by having a locking screw 40 extending through the slot 37 of the second bracket 20 and loosely threaded into the bore 35 of the first bracket 20. After the desired angular position of the second bracket 20 is found, the locking screw 40 is tightened, with the second bracket 20 thereby providing the fixed surface 34 for the third bracket.

This locking prodedure is then repeated on each pair of brackets 20 going from left to right on the assembly, as shown in FIG. 1 until all of the brackets 20 are individually locked into the individual angular positions.

It should be noted that various modifications can be made to the assembly while still remaining within the purview of the following claims.

What is claimed is:

1. A cam-switch assembly comprising:

a pivot rod located on an axis;

a plurality of cam-switches, each cam-switch including a cam follower responsive to a respective cam for actuating a switch;

a plurality of mounting brackets each having means for supporting a cam-switch, said mounting brackets being pivotally supported on said second pivot rod;

said mounting brackets further including means for individually adjusting the angular position of each bracket and cam-switch with respect to said cams, said means further including means for adjustably positioning said bracket with respect to a fixed surface adjacent to said mounting brackets, said positioning means comprising a first wall having an elongated slot extending therethrough for adjustably receiving a locking screw; and each mounting bracket further including locking means for providing a fixed surface for an adjacent mounting bracket, said locking means comprising a second wall having a threaded bore for securedly receiving a locking screw.

2. The combination of claim 1 wherein said first and second walls are parallel with respect to each other.

3. The combination of claim 2 wherein said first and second walls are integrally formed at one end of each mounting bracket into a U-shaped member, with each wall forming a leg of the U.

4. The combination of claim 1 further including a pair of end walls supporting said pivot rod.

5. The combination of claim 4 wherein said end walls further include locking means for providing a fixed surface for an adjacent mounting bracket.

6. The combination of claim 5 wherein said end walls further include an adjustable slot extending therethrough for adjustably receiving a locking screw.

* * * * *